US006170276B1

(12) United States Patent
Mandel et al.

(10) Patent No.: US 6,170,276 B1
(45) Date of Patent: Jan. 9, 2001

(54) HIGH PERFORMANCE FOOD STORAGE SYSTEM FOR A REFRIGERATOR

(75) Inventors: Sheldon Wayne Mandel, East Galesburg; Robert Stephen Mercille, Oneida; William J. Vestal, Monmouth, all of IL (US)

(73) Assignee: Maytag Corporation, Newton, IA (US)

( * ) Notice: Under 35 U.S.C. 154(b), the term of this patent shall be extended for 0 days.

(21) Appl. No.: 09/258,355

(22) Filed: Feb. 26, 1999

(51) Int. Cl.[7] ..... F25D 17/04
(52) U.S. Cl. ..... 62/187; 62/382; 62/407
(58) Field of Search ..... 62/187, 186, 382, 62/440, 441, 405, 407, 408, 93, 94

(56) References Cited

U.S. PATENT DOCUMENTS

| | | |
|---|---|---|
| 1,693,387 | 11/1928 | Juneau et al. . |
| 1,774,312 | 8/1930 | Braeutigam . |
| 2,246,342 | 6/1941 | Brown . |
| 2,404,851 | 7/1946 | Knowles et al. . |
| 3,364,694 | 1/1968 | Cohen et al. . |
| 3,600,905 | 8/1971 | Dymek et al. . |
| 3,638,717 | 2/1972 | Harbour et al. . |
| 3,680,941 | 8/1972 | Shanks . |
| 4,173,378 | 11/1979 | Hanson et al. . |
| 4,732,014 | 3/1988 | Frohbieter . |
| 4,751,826 | 6/1988 | Kawahara et al. . |
| 4,788,832 | 12/1988 | Aoki et al. . |
| 5,095,717 | 3/1992 | Germi . |
| 5,392,615 | 2/1995 | Lim . |
| 5,918,480 * | 7/1999 | Nagata et al. ..... 62/440 |

FOREIGN PATENT DOCUMENTS

| | | |
|---|---|---|
| 719 994 | 7/1996 | (EP) . |

* cited by examiner

*Primary Examiner*—Henry Bennett
*Assistant Examiner*—Marc Norman
(74) *Attorney, Agent, or Firm*—Everett G. Diederiks, Jr.

(57) ABSTRACT

A refrigerator crisper system includes an enclosure defined by inner and outer housings, as well as a food receptacle slidably positioned in the inner housing. The inner and outer housings are spaced so as to define a zone therebetween within which air, generated by a fan mounted entirely within the enclosure, is forced to flow in order to cool the contents of the receptacle. The enclosure is formed with various vanes that direct the cooling air flow above, adjacent the sides and below the receptacle. In the most preferred form of the invention, a temperature sensor and a moisture permeable film are provided to further regulate the food storage environment established in the receptacle.

28 Claims, 5 Drawing Sheets

HIGH PERFORMANCE FOOD STORAGE SYSTEM FOR A REFRIGERATOR

BACKGROUND OF THE INVENTION

1. Field of the Invention

The present invention pertains to the art of refrigerators and, more particularly, to an enhanced crisper system for storing food items in a controlled humidity and temperature environment.

2. Discussion of the Prior Art

In the art of refrigerators, particularly household refrigerators, it is often desirable to create varying humidity and/or temperature storage zones to enhance the preservation of different food items. For instance, it is common to accommodate the storage requirements for certain food items, such as dairy products, meats, fruits and vegetables, by forming separately enclosed storage areas within a fresh food compartment. In most instances, these storage areas are designed to be maintained at temperatures which are different from the temperature of the remainder of the fresh food compartment.

In at least the case of fruits and vegetables, it is typically desirable to isolate these food items from direct contact with a flow of cooling air, especially any cold air flowing into the fresh food compartment from a freezer compartment of the refrigerator, mainly because this cold air can be fairly dry. Therefore, in order to isolate the fruits and vegetables from the desiccating effects of the cold air so as to maintain the moisture content of the fruits and vegetables, it has heretofore been proposed to provide a specialized receptacle storage receptacle within a refrigerator fresh food compartment. A crisper generally takes the form of a slidable bin which is sealed to maintain a relatively high humidity level, while the walls of the bin are chilled to establish a desirable temperature within the bin.

Many different food storage compartments designs have been proposed in the art in an attempt to establish and maintain effective humidity and temperature conditions within the compartment while attempting to avoid the development of condensation. However, there still exists a need for an improved storage compartment system which can maintain a desired humidity level, accurately control the temperature and minimize the tendency for condensation within the compartment.

SUMMARY OF THE INVENTION

The present invention is directed to a high performance refrigerator crisper system which is constructed to prevent the loss of humidity, provide an accurately controlled temperature environment and minimize potential for condensation with a food storage receptacle. In accordance with the invention, the system includes an enclosure, which is mounted within a fresh food compartment of a refrigerator, and a food receptacle, preferably in the form of a bin or drawer, which is slidably mounted between a retracted position, wherein a food storage body portion of the receptacle is generally sealed within the enclosure, and an extended position, wherein the food receptacle is at least partially withdrawn from the enclosure to access the storage body.

In the most preferred form of the invention, the enclosure has an open frontal portion and is defined by inner and outer housings. More specifically, the inner housing is concentrically positioned within and internally spaced from the outer housing. Numerous vanes extend between the inner and outer housings and define flow passages or channels over, around and beneath the inner housing. A rear portion of the enclosure is subdivided by a partition wall into upper and lower plenum chambers. A fan is disposed in the partition wall to generate a flow of cooling air into the upper plenum chamber which is guided by the vanes to flow within the passages across a top wall of the inner housing, down along side walls thereof, along the bottom wall of the inner housing and to the lower plenum chamber. In this manner, the cooling air extends around the entire inner housing to establish a uniform, accurate temperature for the food storage receptacle.

Although the preferred form of the invention recirculates a majority of the air flow in order to ensure a minimal temperature gradient through the recirculated air stream, the outer housing is formed with an intake opening which fluidly communicates the freezer compartment of the refrigerator with the interior of the enclosure, while an exhaust pening also leads from the enclosure. A temperature sensor is referably provided to sense the temperature in the enclosure for use in controlling the flow of cold air from the freezer compartment, in combination with controls provided at the front of the bin.

The system also preferably incorporates a variable moisture permeable film, such as a shape memory polymer, which extends across a portion of the inner housing. The presence of the film aids in assuring optimum humidity, minimum condensation and accurate temperature control within the bin in order to improve the useful life of the food items stored therein. The film has associated characteristics enabling the humidity permeability to increase with increasing temperatures. When the temperature in the bin is low, the film functions to prevent the escape of water vapors from within the bin. However, when the temperature increases, excess water vapor will be permitted to escape, thus greatly reducing the possibility of dew condensation.

Additional objects, features and advantages of the invention will become readily apparent from the following detailed description of a preferred embodiment of the invention when taken in conjunction with the drawings wherein like reference numerals refer to corresponding parts in the several views.

DETAILED DESCRIPTION OF THE PREFERRED EMBODIMENTS

Figure 1:
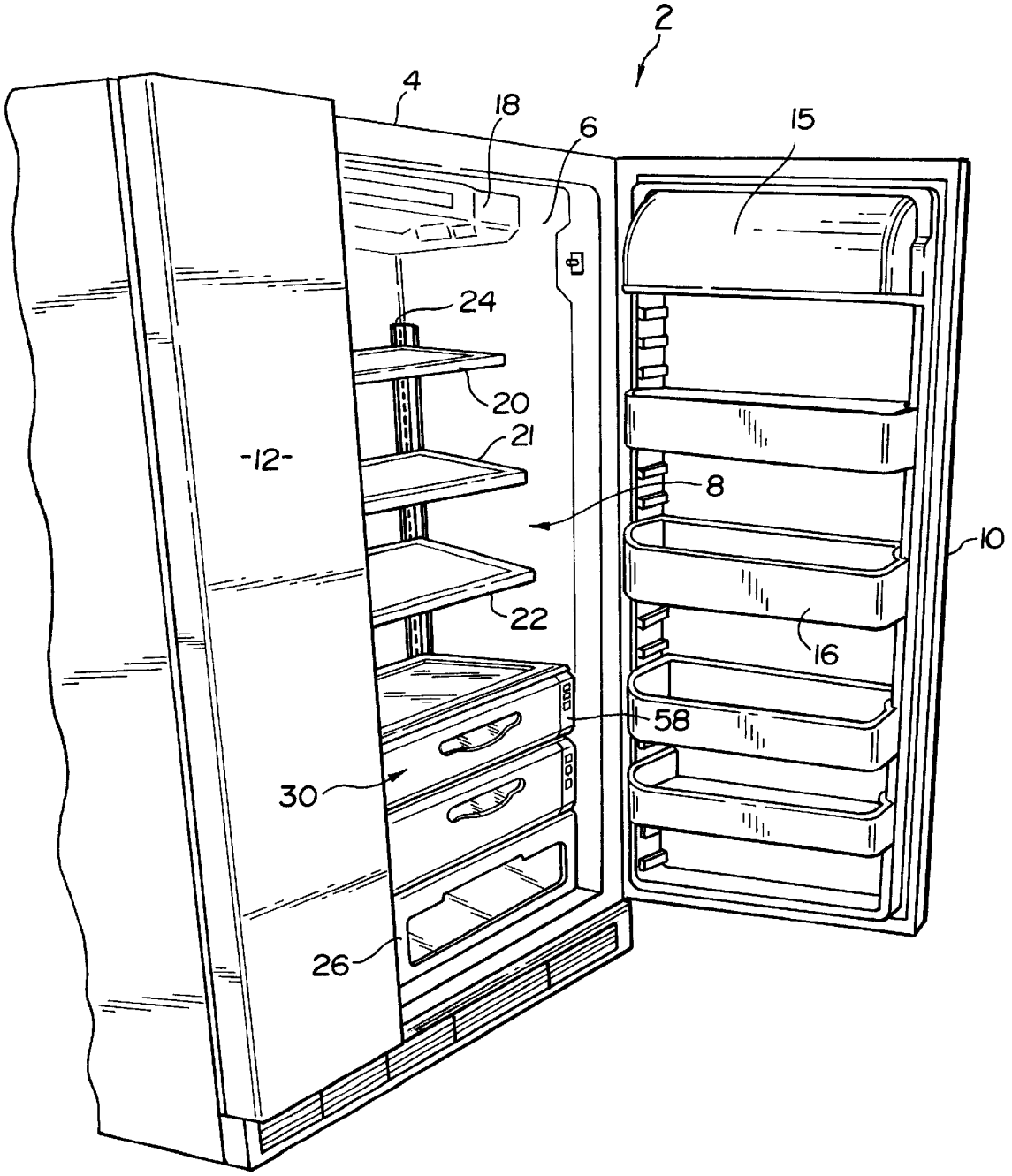
FIG. 1 is a partial, front perspective view of a side-by-side refrigerator incorporating the system of the present invention in the fresh food compartment thereof.
Figure 2:
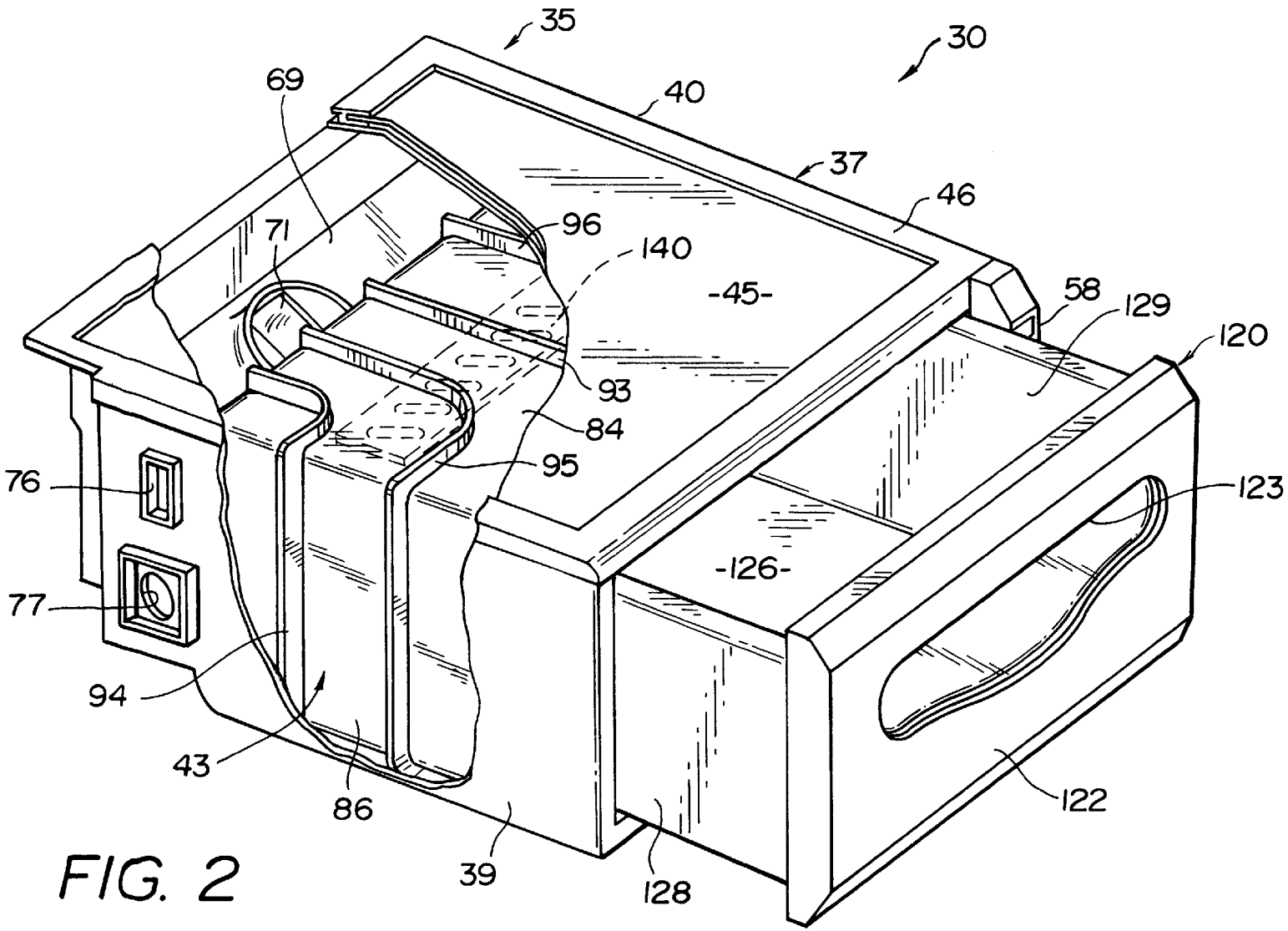
FIG. 2 is an enlarged, partial cut-away view of the system illustrated in FIG. 1.

With initial reference to FIG. 1, a refrigerator cabinet 2 includes a shell 4 within which is positioned a liner 6 that defines a fresh food compartment 8. In a manner known in the art, fresh food compartment 8 can be accessed by the selective opening of a fresh food door 10. In a similar manner, a freezer door 12 can be opened to access a liner defined freezer compartment (not shown). For the sake of completeness, refrigerator cabinet 2 is shown to include, on door 10, a dairy compartment 15 and various vertically adjustable shelving units, one of which is indicated at 16. Mounted in an upper area of fresh food compartment 8 is a temperature control housing 18 which, in a manner known in the art, can be used to regulate the temperature in both fresh food compartment 8 and the freezer compartment. Further illustrated, for exemplary purposes, is a plurality of shelves 20–22 which are cantilevered from spaced rails, one of which is indicated at 24. At a lowermost portion of fresh food compartment 8 is illustrated a slidable bin 26. As indicated above, the above described structure is known in the art and presented only for the sake of completeness. The present invention is particularly directed to a food storage compartment system which is generally indicated at 30. Although FIG. 1 actually illustrates two such compartment systems 30, it should be realized that the actual number of compartment systems 30 can be readily varied.

Reference will now be made to FIGS. 2–5 in describing a first preferred embodiment of the system 30 of the present invention. As illustrated, system 30 includes an enclosure 35 having an outer housing 37, formed from a lower section 39 and an upper section 40, and an inner housing 43. Given that the embodiment shown in FIGS. 2–5 corresponds to the upper system 30 shown in FIG. 1, upper section 40 of enclosure 35 is preferably defined by a glass plate 45 that is encapsulated in a plastic rim 46 such that the upper section 40 of the enclosure 35 has an upper exposed surface generally similar to each of cantilevered shelves 20–22. It should also be realized, however, that upper section 40 could simply be constituted by a unitary plate, such as one formed of plastic.

In the most preferred form, lower section 39 of outer housing 37 includes a bottom wall 48, an upstanding rear wall 49, upstanding side walls 51 and 52 and an open frontal portion indicated at 54. In the preferred embodiment, the entire lower section 39 of outer housing 37 is integrally molded of plastic, with a wall 56 projecting laterally from side wall 52 as perhaps best shown in FIG. 3. Wall 56 establishes a mounting section 57 within which a control module 58 (see FIG. 1) is arranged.

Referring back to FIGS. 2–5, the bottom wall 48 of lower section 39 of outer housing 37 has a first, frontal section 60 which leads to a raised second, rear section 61. Bottom wall 48 is preferably formed with a plurality of vanes, including a central vane 63 and various spaced, curved vanes 64–67. Rear section 61 of outer housing 37 also has associated therewith a partition plate 69 having a central aperture through which projects an impeller portion of a fan 71. Fan 71 includes an electric motor 72 which is secured to partition plate 69 by means of a bracket 73. The actual positioning and mounting of partition plate 69 will be discussed more fully below. However, at this point, it should be realized that partition plate 69 is adapted to be mounted within rear section 61 between spaced openings 76 and 77. In this embodiment, opening 76 constitutes an air inlet and opening 77 defines an air outlet such that the zone above partition plate 69 defines an upper plenum chamber 79 and the zone below partition plate 69 defines a lower plenum chamber 80. Again, this structure will be more fully brought out when describing the remaining structure associated with storage compartment system 30.

As indicated above, system 30 also includes an inner housing 43 that is preferably molded of plastic to include a top wall 84, a bottom wall 85, side walls 86 and 87, a rear wall 88 and an open frontal portion 89. In the preferred form of the invention, open frontal portion 89 is formed with an annular, outwardly extending flange 90. As clearly shown in these figures, top wall 84 of inner housing 43 is formed with a central vane 93, as well as various spaced and curved vanes 94–97, each of which extends from adjacent rear wall 88 a predetermined distance towards annular flange 90 in a manner essentially parallel to central vane 93. Thereafter, each vane 94–97 includes an arcuate section which leads the vane towards a respective side wall 86, 87. Each of the vanes 94–97 then extends downwardly along a respective side wall 86, 87. Furthermore, in the most preferred form of the invention, rear wall 88 includes lateral extensions 99 and 100 which also define vanes at a rear edge portion of side walls 86 and 87 respectively.

Inner housing 43 is adapted to be positioned within outer housing 37 in a manner which aligns the lower terminal ends of vanes 94–97 at side walls 86 and 87 with curved side vanes 64–67. With the alignment of these vanes, enclosure 35 defines various channels or passages between respective sets of the vanes. For example, vanes 93 and 96 establish an air flow passage 101, in conjunction with upper section 40, which extends from upper plenum chamber 79 toward annular flange 90, then downward along side wall 87, between bottom wall 85 of inner housing 43 and bottom wall 48 of outer housing 37. Between these bottom walls, passage 101 continues due to the arrangement of central vane 63 and curved vane 66 into lower plenum chamber 80. Given the arrangement of the numerous vanes and the formation of the various passages, a flow of air developed by fan 71 will be assured to extend across essentially the entire outer surface area of inner housing 43.

At this point, it is important to note that outer housing 37 has a greater depth than inner housing 43. This is perhaps best illustrated in FIGS. 4 and 5. It is based on this difference in depth that partition plate 69 can be arranged to define the upper and lower plenum chambers 79 and 80. More specifically, in the preferred embodiment, rear wall 88 of inner housing 43 is preferably formed with a pair of horizontally extending projections 106 and 107 and rear wall 49 of outer housing 37 is integrally formed with a ledge 109. Partition plate 69 has one lateral edge arranged between projections 106 and 107 and a second, laterally extending edge which is seated upon ledge 109 such that fan 71 is advantageously angled upwardly and forwardly.

With this arrangement, air within enclosure 35 will be forced to flow upwardly out of upper plenum chamber 79 across substantially the entire top wall 84 of inner housing 43, down between side walls 86, 87 and side walls 51 and 52, within the passages defined between bottom wall 48 and bottom wall 85 and to return into lower plenum chamber 80. In accordance with the preferred embodiment of the invention, a majority of the air returning to lower plenum chamber 80 is recirculated. However, inlet 76 is placed in fluid communication with air flowing within the freezer compartment of refrigerator cabinet 2 through the vertical dividing wall or mullion (not shown) which conventionally separates the refrigerator compartments. Supplying cold air from a freezer compartment to a specialty compartment zone is fairly conventional in the art. In accordance with the preferred embodiment, a damper (not shown) is preferably provided to control the amount of cold air flowing into inlet 76, with the damper being regulated through the manual setting of control module 58. Although further details of the damper arrangement will be provided below, at this point it should be noted that a temperature sensor 116 is preferably provided within lower plenum chamber 80 (see FIG. 5), with the temperature sensor 116 being connected to control module 58 for use in regulating the damper that controls the amount of intake air permitted to flow through inlet 76.

Figure 3:
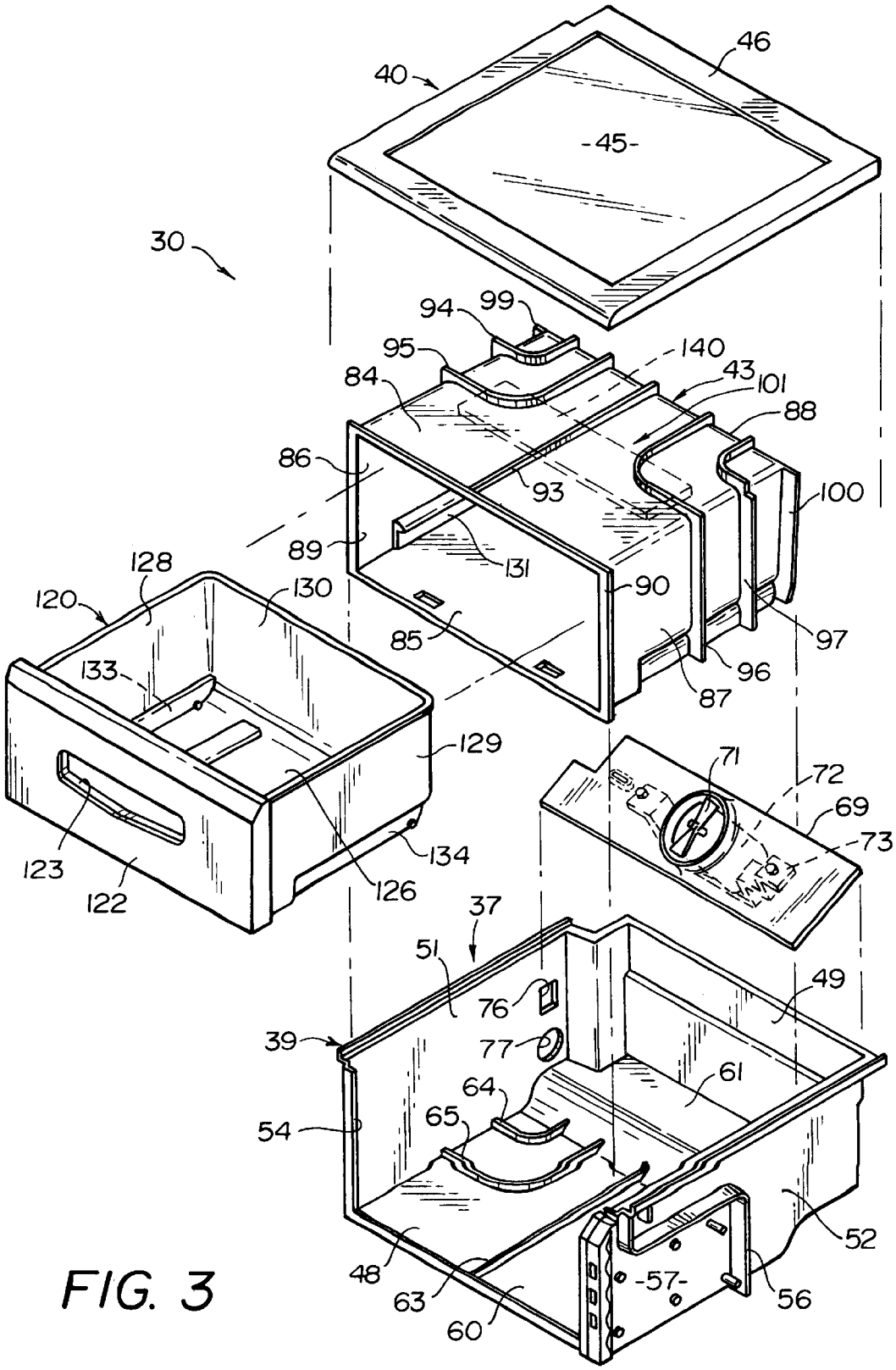
FIG. 3 is an exploded view of the system constructed in accordance with a first embodiment of the invention.
Figure 4:
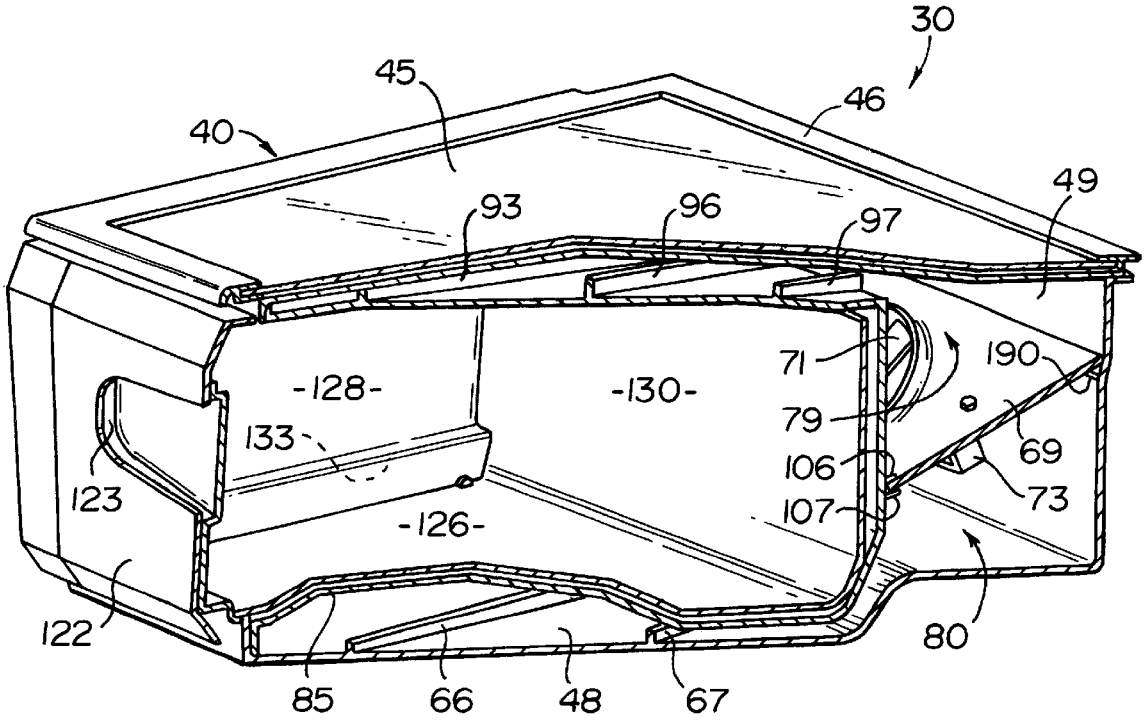
FIG. 4 is a perspective view of the system of FIG. 3 with a cut-away portion.
Figure 5:
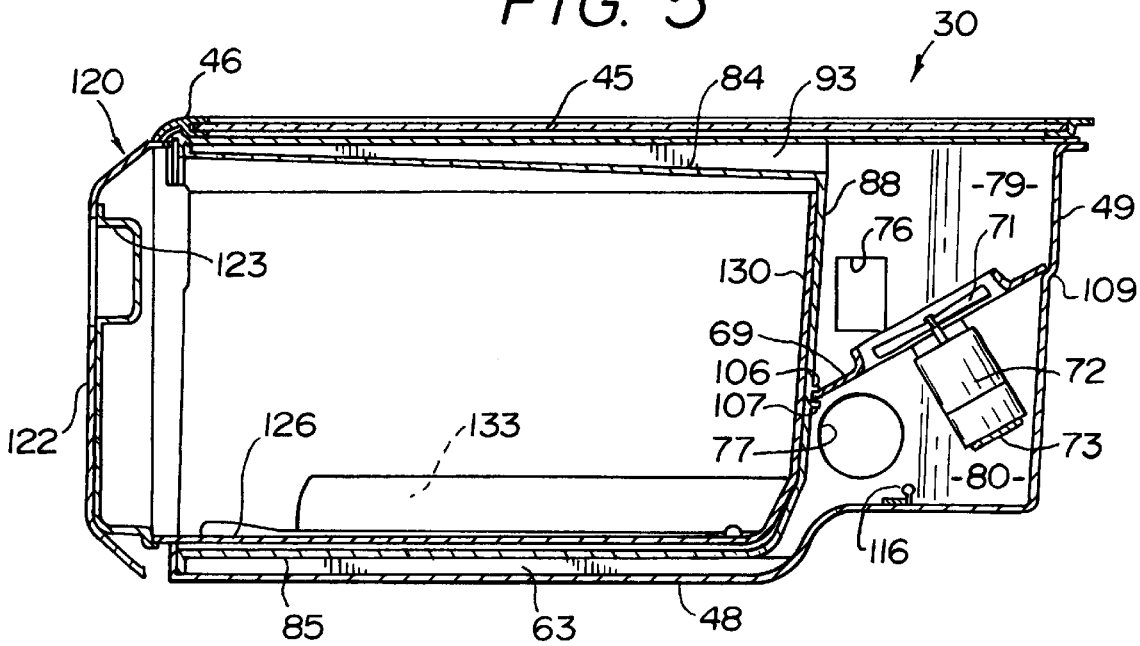
FIG. 5 is a cross-sectional side view of the crisper system of FIGS. 3 and 4.

Crisper system 30 also includes a receptacle 120 that takes the form of a drawer or bin having a front wall 122 provided with a handle 123, a floor 126, side walls 128 and 129 and a rear wall 130. In the preferred embodiment shown, floor 126, side walls 128 and 129 and rear wall 130 are integrally molded of plastic and a plastic front wall 122 is secured thereto, such as through sonic welding. Receptacle 120 is adapted to be slidably mounted within inner housing 43 between a retracted position, as best shown in FIGS. 4 and 5, and an extended position wherein a storage area defined by receptacle 120 can be accessed for the placement and removal of food items, such as fruits and vegetables. For slidably supporting receptacle 120, inner housing 43 is preferably provided with a pair of horizontally extending rails, one of which is shown in FIG. 3 at 131, which extend within elongated recesses 133 and 134 defined at the lowermost section of side walls 128 and 129. Of course, other types of guiding support arrangements could be readily provided without departing from the spirit of the invention.

When fully closed, the front wall 122 of receptacle 120 tightly abuts enclosure 35 such that system 30 essentially provides a tightly sealed bin so as to prevent the undesirable loss of humidity. Since a cooling air flow extends essentially around the entire outer surface of inner housing 43, each of the side walls 128 and 129 and rear wall 130 of receptacle 120 are indirectly cooled, as well as the interior of the receptacle 120. This uniform cooling arrangement, in combination with the inclusion and operation of fan 71 and the controlled introduction and exhaust of air into and out of enclosure 35, enables an accurate temperature control environment to be established for the system 30, while minimizing any tendency for condensation within receptacle 120. Again, the preferable flow of air developed by fan 71 is upward from behind receptacle 120, passes over the top of the receptacle 120 and, through the use of vanes 63–67 and 93–97, is channeled adjacent to the sides and then across the bottom until it returns to lower plenum chamber 80. Therefore, the flow path causes the air to effectively contact all of the containment surfaces of receptacle 120 in order to provide a good transfer of heat. Although the preferred embodiment incorporates temperature sensor 116 to regulate the amount of cold air drawn into upper plenum chamber 79 from the freezer compartment as established by the manually set controls, it should be noted that cold air from the freezer compartment could be drawn into the enclosure by virtue of the relative static pressure between the freezer compartment and the low pressure plenum chamber 80 of enclosure 35. As indicated above, this flow could also be controlled by an electromechanical damper regulated by the electronic control module 58. In any event, as cold air is injected from the freezer compartment into inlet 76, a corresponding amount of air is ejected from enclosure 35 through outlet 77. Typically, the ratio of circulated air to injected air would be quite high in order to ensure minimal temperature gradient throughout the circulated air stream, with the purpose being to cool the contents of the receptacle 120 with a minimum overall temperature difference between the air in the receptacle 120 and the cooling air stream flowing between the inner and outer housings 43 and 37.

In accordance with another aspect of the invention, system 30 preferably incorporates a variable moisture permeable film, such as a urrently available shape memory polymer. The potential incorporation of this film is illustrated at 140 by the dotted lines shown in FIG. 2 as incorporated in top wall 84 of inner housing 43. The function of such a variable moisture permeable film is to maintain the optimum humidity, minimize condensation and further enhance the ability of system 30 to establish an optimum temperature so as to improve the shelf life of produce or the like stored in receptacle 120. More specifically, shape memory polymers are known to perform humidity control functions as the material inherently increases in moisture permeability with increasing temperature. Therefore, when the temperature remains low in receptacle 120, water vapor is kept from escaping. However, when the temperature increases, the excess water vapor can escape. This reduces the possibility of dew condensation in receptacle 120. Such a shape memory polymer, as currently available in the marketplace, has a glass transition temperature around which its moisture permeability rapidly changes. The moisture permeability range, glass transition temperature, location and an amount of surface area exposed directly to the food items placed within receptacle 120 can be readily optimized to reduce condensation in retaining the optimum humidity level. Although the speed of operation of fan 71 could be regulated through control module 58 to enhance the rate at which the conditioned air flows within enclosure 35 to control the moisture transfer rate through the shape memory polymer material, in the most preferred form of the invention, fan 71 is simply controlled to be either on or off. In any case, when such a known moisture permeable film is included in system 30, fan 71 will aid in regulating the moisture transfer rate through the material to further aid in establishing the optimum humidity in the receptacle 120.

Figure 6:
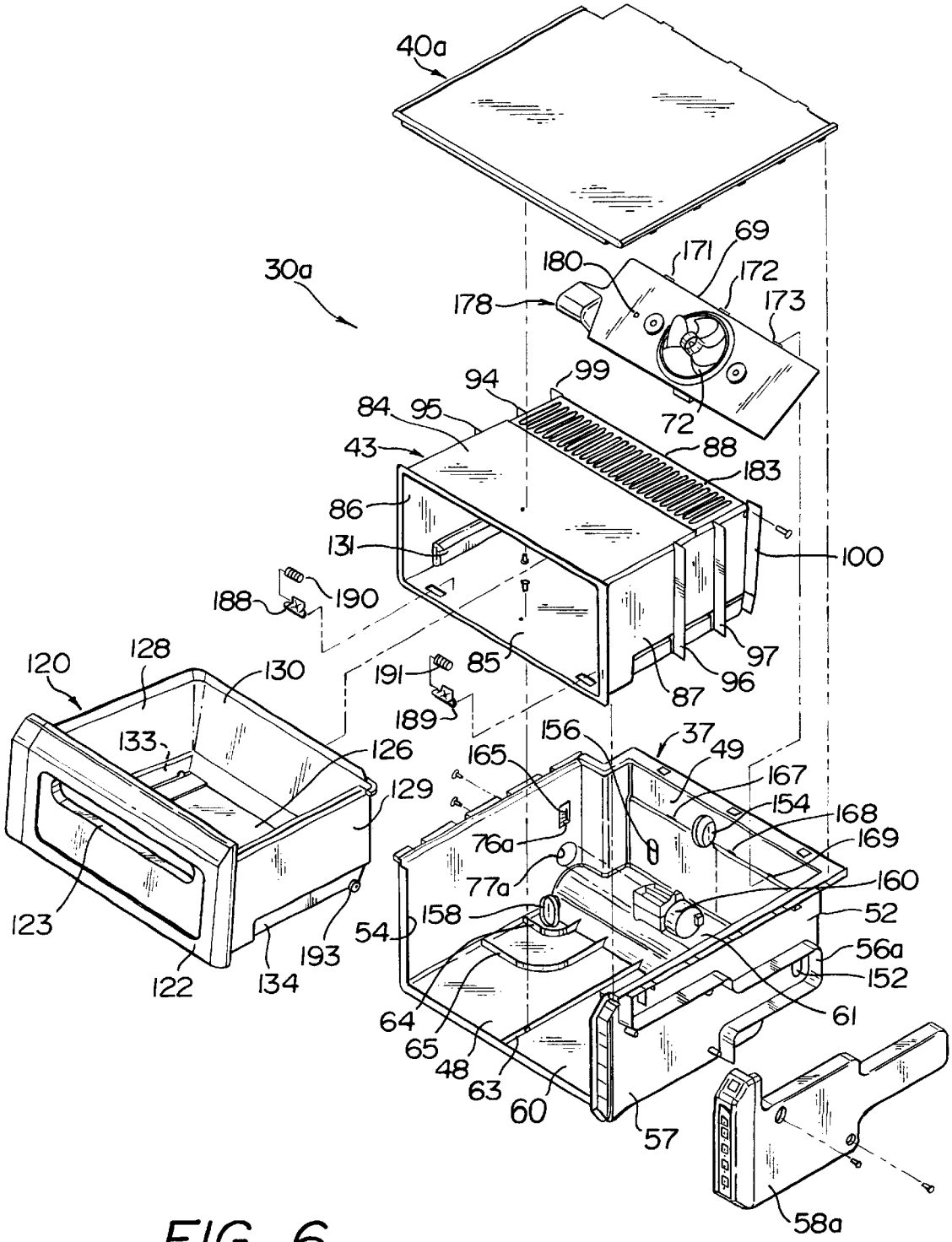
FIG. 6 is an exploded view similar to that of FIG. 3 but depicting a system constructed in accordance with a second embodiment of the invention.

Reference will now be made to FIG. 6 in describing another preferred embodiment for the system of the present invention. In general, the system 30*a* of this embodiment is constructed and operates in a manner corresponding to that described above with respect to the first embodiment of the invention. However, this embodiment brings out further potential design modifications within the scope of the overall invention. Since a majority of the structure of this embodiment directly corresponds to that described above, like reference numerals will refer to corresponding parts in the several views and the differences between the embodiments will be brought out below, with these differences being generally apparent from comparing FIGS. 3 and 6 of the present application.

First of all, in accordance with the embodiment of FIG. 6, it should be noted that outer housing 37 is provided with a slightly differently configured wall 56*a* to accommodate control module 58*a*. At a rear portion of upstanding side wall 52 of outer housing 37, there is shown an opening 152 which is provided for the routing of wires to control module 58*a*. A corresponding type of opening would also be provided in the first embodiment described above but has not been shown to simplify the drawings. In any event, as depicted in FIG. 6, opening 152 receives a plug 154 through which the wires would extend. A similar opening 156 is depicted for upstanding rear wall 49 which also receives a plug 158 that can accommodate the passage of wires therethrough.

One major distinction between the embodiment shown in FIGS. 2–5 and that illustrated in FIG. 6 is that opening 76*a* and this embodiment represents an air outlet for the system and opening 77*a* represents the inlet. Mounted at air inlet 77*a* is a damper 160 that is electrically linked to control module 58*a* by suitable wiring (not shown). In accordance with this embodiment, air outlet 76*a* is also provided with a flap valve indicated at 165. Another difference in the construction of outer housing 37 of this embodiment is the inclusion of various laterally spaced slots 167–169 that are provided in upstanding rear wall 49 for the mounting of partition plate 69. Correspondingly, partition plate 69 is provided with various laterally spaced tabs 171–173 such that, unlike the first embodiment where the partition plate 69 rests against ledge 109, the tabs 171–173 are received within respective slots 167–169 for the securing of partition plate 69.

In addition, it will be noted that partition plate 69 of this embodiment is formed with a deflector 178 which is shaped to conform to a portion of damper 160 when the system 30*a* is assembled but which is maintained spaced from rear wall 88 of inner housing 43 a slight distance which enables warmer air to bleed adjacent to air inlet 77*a*. Therefore, deflector 178 allows some mixing of warmer air with the coldest air delivered into outer housing 37 through air inlet 77*a*. Furthermore, partition 69 is provided with an aperture 180 through which is adapted to project a temperature sensor (not shown) which replaces temperature sensor 116 in that it signals control module 58*a* for regulating the opening and closing of damper 160.

With this arrangement, the amount of inlet air drawn into lower plenum chamber 80 through opening 77*a* is controlled by the opening and closing of damper 160. Fan 72 operates in the manner described above in that it functions to direct air over the top wall 84, along side walls 86 and 87 and along bottom wall 85 of inner housing 43. Depending upon the pressure differential created, flap valve 165 can permit a percentage of the air flow to be exhausted from within the enclosure 35. This embodiment also illustrates that it is possible to remove vanes 94–97 from the top wall 84 of inner housing 43. In this embodiment, the corresponding portions of the vanes are provided beneath upper section 40*a* to perform the identical air directing function. The embodiment of FIG. 6 also illustrates the inclusion of a grill 183 as part of top wall 84. Grill 183 can be integrally formed with inner housing 43 or formed as a separate piece and attached thereto. In either case, grill 183 is adapted to have secured thereto a corresponding, variable moisture permeable film (not shown) by any means known in the art, including sonic welding or through the use of an adhesive. Although not specifically described above with respect to the first embodiment of the invention, a similar grill or opening arrangement will also be associated with film 140.

Finally, this embodiment illustrates additional structural details that are preferably incorporated in the embodiment of FIG. 1 as well, such as the use of snap-in roller supports 188 and 189 that receive rollers 190 and 191, as well as the inclusion of rollers 193 on either side of receptacle 120. In any case, with the above construction of the storage compartment system in accordance with either of the embodiments described, an effective heat transfer with receptacle 120 is assured, given that the temperature of the circulated air is regulated and efficiently channeled substantially entirely about the receptacle. The moisture permeable film can further enhance the ability of the system to maintain a desired humidity and temperature environment. Furthermore, since the storage compartment system is essentially self-contained, it can be pre-assembled and advantageously mounted as a unit within refrigerator cabinet 2. In any event, although described with respect to the preferred embodiment of the invention, it should be readily apparent that various changes and/or modifications can be made to the storage compartment system of the present invention without departing from the spirit thereof. For example, although a sensed temperature-based control system has been disclosed to establish air intake/exhaust rates for enclosure 35, a simple mechanical damper arrangement, as widely known in the art in connection with storage compartment systems, could also be utilized. In any event, the invention is only intended to be limited by the scope of the following claims.

We claim:

1. In a refrigerator including a liner mounted within a cabinet shell so as to define a refrigerator storage compartment, a crisper system comprising:

an enclosure mounted within the storage compartment, said enclosure having an open frontal portion and being defined by inner and outer walls, with the inner walls being arranged within and internally spaced from the outer walls, one of said outer walls being provided with an opening for the introduction of a flow of cooling air between the inner and outer walls; and a food receptacle including a storage body having a front wall, said food receptacle being slidably mounted for movement relative to the enclosure between a retracted position, wherein the storage body is arranged within the inner walls and the front wall extends across the open frontal portion of the enclosure such that food items supported within the storage body are indirectly cooled by the air flowing between the inner and outer walls, and an extended position, wherein the food receptacle is at least partially withdrawn from the enclosure to access the storage body.

2. The crisper system according to claim 1, further comprising: a plurality of vanes interposed between the inner and outer walls, with the vanes defining a plurality of passages for guiding the air flowing within the enclosure.

3. The crisper system according to claim 2, wherein the passages extend adjacent top, side and bottom portions of said food receptacle.

4. The crisper system according to claim 3, wherein at least one of the plurality of the passages extends along each of the top, side and bottom portions of the food receptacle.

5. The crisper system according to claim 2, wherein said vanes are formed on predetermined ones of each of the inner and outer walls.

6. The crisper system according to claim 1, wherein the inner and outer walls form inner and outer housings respectively, said inner housing being arranged within and internally spaced from the outer housing.

7. The crisper system according to claim 6, wherein the outer housing has an associated depth which is greater than a depth of the inner housing such that a rear chamber is defined within the enclosure, said crisper system further comprising a partition member dividing the rear chamber into first and second chambers, said opening leading through the outer housing into the first chamber.

8. The crisper system according to claim 7, further comprising: a fan mounted to the partition member for generating the flow of cooling air which circulates from the first chamber, between the inner and outer housings and around the food receptacle.

9. The crisper system according to claim 8, wherein the first and second chambers are vertically arranged within the enclosure, said enclosure further including an air outlet leading from one of the first and second chambers.

10. The crisper system according to claim 9, further comprising: a deflector carried by the partition member for diverting a percentage of the flow of cooling air directly between the first and second chambers.

11. The crisper system according to claim 8, further comprising: a control unit for regulating humidity and temperature levels in the food receptacle.

12. The crisper system according to claim 11, further comprising: a temperature sensor for signaling a sensed temperature within the enclosure to the control unit.

13. The crisper system according to claim 12, further comprising: a damper for controlling an introduction of air into the enclosure through the opening, said damper being regulated by the control unit based on the sensed temperature of the temperature sensor.

14. The crisper system according to claim 1, further comprising: a moisture permeable material attached to one of the inner walls in communication with both an interior of the food receptacle and the flow of cooling air.

15. In a refrigerator including a liner mounted within a cabinet shell so as to define a refrigerator storage compartment, a crisper system comprising:

an enclosure mounted within the storage compartment, said enclosure being provided with an opening for the introduction of cooling air therein;

a fan for developing a flow of the cooling air, said fan being arranged entirely within the enclosure; and a food receptacle including a storage body having a front wall, said food receptacle being slidably mounted for movement relative to the enclosure between a retracted position, wherein the storage body is arranged within the enclosure and the front wall extends across the open frontal portion of the enclosure such that food items supported within the storage body are cooled by the flowing air, and an extended position, wherein the food receptacle is at least partially withdrawn from the enclosure to access the storage body.

16. The crisper system according to claim 15, wherein the enclosure includes inner and outer housings, with the inner housing being positioned within and internally spaced from the outer housing.

17. The crisper system according to claim 16, wherein the outer housing has an associated depth which is greater than a depth of the inner housing such that a rear chamber is defined within the enclosure, said crisper system further comprising a partition member dividing the rear chamber into first and second chambers, said opening leading through the outer housing into the first chamber.

18. The crisper system according to claim 17, further comprising: a fan mounted to the partition member for generating the flow of cooling air which circulates from the first chamber, between the inner and outer housings and around the food receptacle.

19. The crisper system according to claim 18, wherein the first and second chambers are vertically arranged within the enclosure, said enclosure further including an air outlet leading from one of the first and second chambers.

20. The crisper system according to claim 19, further comprising: a deflector carried by the partition member for diverting a percentage of the flow of cooling air directly between the first and second chambers.

21. The crisper system according to claim 15, further comprising: a control unit for regulating humidity and temperature levels in the food receptacle.

22. The crisper system according to claim 21, further comprising: a temperature sensor for signaling a sensed temperature within the enclosure to the control unit.

23. The crisper system according to claim 22, further comprising: a damper for controlling an introduction of air into the enclosure through the opening, said damper being regulated by the control unit based on the sensed temperature of the temperature sensor.

24. The crisper system according to claim 16, further comprising: a moisture permeable material attached to the inner housing in communication with both an interior of the food receptacle and the flow of cooling air.

25. The crisper system according to claim 16, further comprising: a plurality of vanes interposed between the inner and outer housings, with the vanes defining a plurality of passages for guiding the air flowing within the enclosure.

26. The crisper system according to claim 25, wherein the passages extend adjacent top, side and bottom portions of said food receptacle.

27. The crisper system according to claim 26, wherein at least one of the plurality of the passages extends along each of the top, side and bottom portions of the food receptacle.

28. The crisper system according to claim 25, wherein said vanes are formed on portions of each of the inner and outer housings.

* * * * *

UNITED STATES PATENT AND TRADEMARK OFFICE

CERTIFICATE OF CORRECTION

PATENT NO. : 6,170,276 B1
DATED : January 9, 2001
INVENTOR(S) : Sheldon W. Mandel et al.

It is certified that error appears in the above-identified patent and that said Letters Patent is hereby corrected as shown below:

Title page,
Item [57], ABSTRACT,
Line 1, “crisper” should read -- food storage --

Column 1,
Line 8, delete “crisper”
Line 31, delete “receptacle”
Line 32, after “receptacle” insert -- , such as a crisper, --
Line 50, “crisper” should read -- storage compartment --
Line 52, after “minimize” insert -- the --

Column 2,
Line 47, after “the” (first occurrence) insert -- high performance food storage --
Line 55, delete “crisper”

Column 5,
Line 5, delete “Crisper”
Line 5, “system” should read -- System --
Line 26, “bin” should read -- crisper --

Column 6,
Line 5, after “of” insert -- storage compartment --
Line 33, after “the” (first occurrence) insert -- food storage --

Signed and Sealed this

Twenty-seventh Day of August, 2002

*Attest:*

*Attesting Officer*

JAMES E. ROGAN
*Director of the United States Patent and Trademark Office*